US008777593B2

(12) United States Patent
Kinoshita et al.

(10) Patent No.: US 8,777,593 B2
(45) Date of Patent: Jul. 15, 2014

(54) ELECTRIC COMPRESSOR

(75) Inventors: Yusuke Kinoshita, Kariya (JP); Yumin Hishinuma, Kariya (JP); Kazuhiro Kuroki, Kariya (JP); Tetsuhiko Fukanuma, Kariya (JP); Tomoyuki Miyoshi, Nisshin (JP); Yasushi Kato, Toyota (JP); Yuji Nakane, Okazaki (JP)

(73) Assignees: Kabushiki Kaisha Toyota Jidoshokki, Aichi-ken (JP); Toyota Jidosha Kabushiki Kaisha, Aichi-ken (JP)

( * ) Notice: Subject to any disclaimer, the term of this patent is extended or adjusted under 35 U.S.C. 154(b) by 437 days.

(21) Appl. No.: 13/072,313

(22) Filed: Mar. 25, 2011

(65) Prior Publication Data

US 2011/0243771 A1 Oct. 6, 2011

(30) Foreign Application Priority Data

Mar. 30, 2010 (JP) ..... 2010-079735

(51) Int. Cl.
*F04B 17/03* (2006.01)
*B60K 5/00* (2006.01)
*B60K 28/14* (2006.01)

(52) U.S. Cl.
USPC ..... 417/410.1; 180/232; 180/274

(58) Field of Classification Search
USPC ..... 417/410.1; 180/232, 274, 291
See application file for complete search history.

(56) References Cited

U.S. PATENT DOCUMENTS 7,973,439 B2 7/2011 Watanabe et al.
8,299,662 B2 * 10/2012 Schmidt et al. ..... 310/52
2002/0191385 A1 12/2002 Miyazaki
2003/0200761 A1 * 10/2003 Funahashi et al. ..... 62/228.4
2010/0172772 A1 * 7/2010 Watanabe et al. ..... 417/410.1
2010/0226800 A1 * 9/2010 Ichise et al. ..... 417/410.5

FOREIGN PATENT DOCUMENTS

JP 2002-362254 A 12/2002
JP 2004-262412 A 9/2004
JP 2004-324278 A 11/2004
JP 2007-282309 A 10/2007
JP 2009-85082 A 4/2009
JP 2009-092000 A 4/2009
JP 2009-103100 A 5/2009
JP 2009-114958 A 5/2009
JP 2009-150483 A 7/2009
JP 2009-243347 A 10/2009
JP 2010-048103 A 3/2010

OTHER PUBLICATIONS

Japanese Office Action issued in corresponding Japanese Application No. 2010-079735, dated Dec. 13, 2011.

* cited by examiner

*Primary Examiner* — Charles Freay
(74) *Attorney, Agent, or Firm* — Sughrue Mion, PLLC

(57) ABSTRACT

An electric compressor is installed in a vehicle and includes a shell. The electric compressor includes an inverter, a cover, and a conductive component. The cover covers the shell and the inverter. The conductive component is electrically connected to the inverter and arranged outside the cover. The cover includes an outer guide surface inclined relative to a forward direction of the vehicle. The outer guide surface has a normal including a forward component directed in the forward direction. The outer guide surface is arranged closer to an outer side of the vehicle than the conductive component.

10 Claims, 8 Drawing Sheets

ELECTRIC COMPRESSOR

BACKGROUND OF THE INVENTION

The present invention relates to an electric compressor installed in a vehicle, and more particularly, an electric compressor including an inverter and a cover with the inverter being covered by the cover and a shell of the electric compressor.

If a vehicle that includes an electric compressor crashes, the crash may damage an inverter housing (cover), which covers an inverter, and a high voltage unit of the inverter. This may cause electrical leakage.

Japanese Laid-Open Patent Publication No. 2009-103100 describes an electric compressor including an inverter and a compressor housing. A projection projects from the compressor housing toward the engine. When the vehicle crashes, the projection hits the engine before the housing and the inverter. This lowers the possibility of the inverter housing and inverter hitting the engine and, in turn, raises the probability that electrical leakage will be avoided if the vehicle crashes.

However, peripheral devices arranged near the electric compressor may hit and break the inverter housing when the vehicle crashes. Japanese Laid-Open Patent Publication No. 2009-103100 does not discuss any resolution to such a situation.

SUMMARY OF THE INVENTION

It is an object of the present invention to provide an electric compressor that has surfaces arranged to protect an inverter when the vehicle crashes and a peripheral device hits a cover, which covers the inverter.

One aspect of the present invention is an electric compressor installed in a vehicle and including a shell. The electric compressor includes an inverter. A cover covers the shell and the inverter. A conductive component is electrically connected to the inverter and arranged outside the cover. The cover includes an outer guide surface inclined relative to a forward direction of the vehicle. The outer guide surface has a normal including a forward component directed in the forward direction. The outer guide surface is arranged closer to an outer side of the vehicle than the conductive component.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE INVENTION

A first embodiment of the present invention will now be discussed with reference to FIGS. 1A to 4.

Figure 1A:
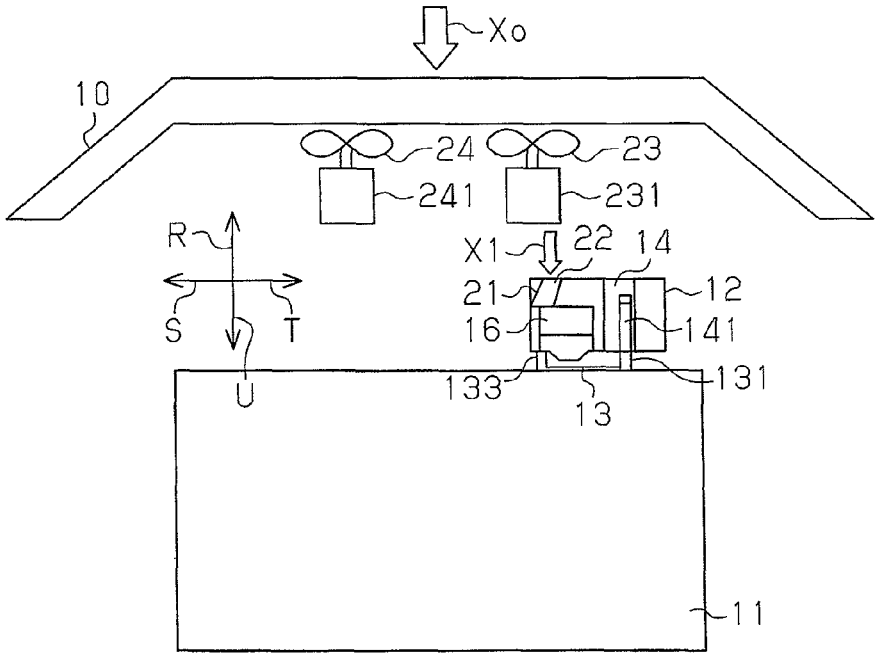
FIG. 1A is a plan view showing an electric compressor according to a first embodiment of the present invention.

As shown in FIG. 1A, a vehicle includes an engine 11. An electric compressor 12 is coupled to the front of the engine 11 by a bracket 13, which is fixed to the engine 11. The vehicle includes a front bumper 10. In FIG. 1, the direction of arrow R indicates the forward direction of the vehicle.

Figure 1B:
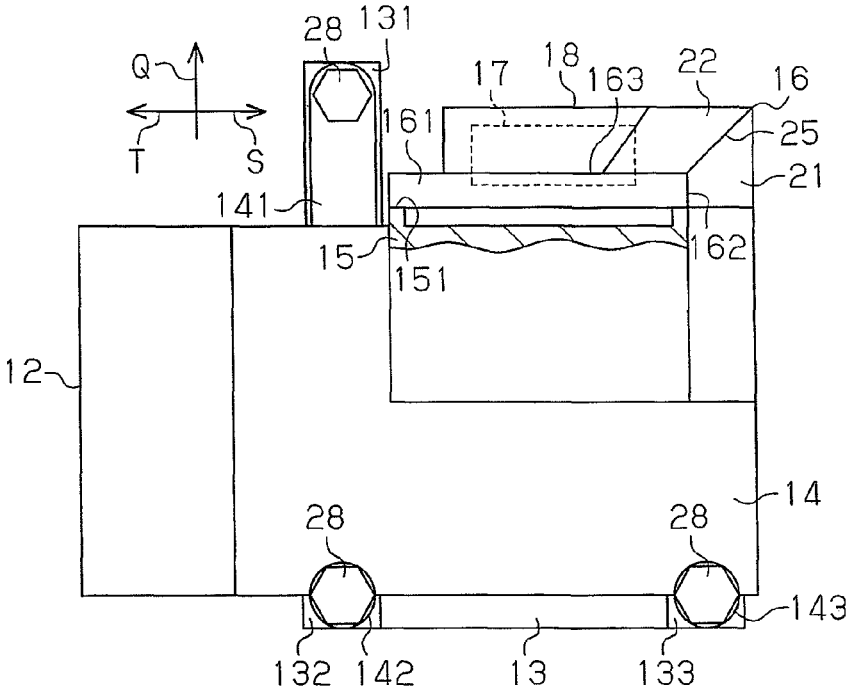
FIG. 1B is a front view showing the electric compressor of FIG. 1A.

Referring to FIG. 1B, the electric compressor 12 includes a motor housing 14, which accommodates an electric motor (not shown). The motor housing 14 includes coupling legs 141, 142, and 143. The bracket 13 includes nut portions 131, 132, and 133 facing toward the coupling legs 141, 142, and 143, respectively. Bolts 28 are inserted through the coupling legs 141, 142, and 142 and mated with the nut portions 131, 132, and 133. The bolts 28 are fastened to fix the electric compressor 12 to the bracket 13.

Figure 4:
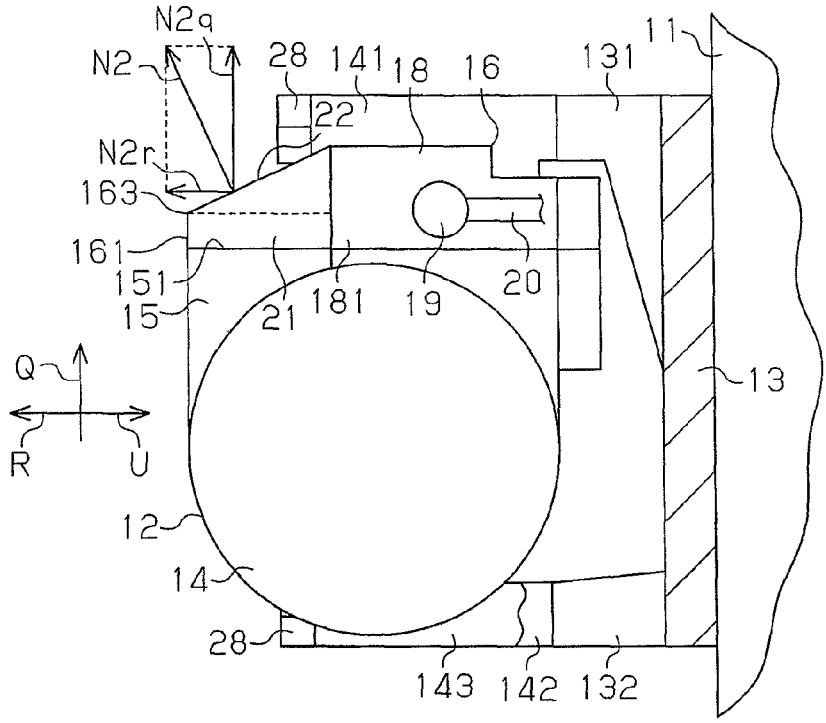
FIG. 4 is a side view showing the electric compressor of FIG. 1A.

Referring to FIGS. 1B and 4, a support base 15 is formed integrally with an upper surface of the motor housing 14, which serves as a shell of the electric compressor 12. In FIGS. 1B and 4, the direction of arrow Q indicates the upward direction. The support base 15 includes an upper rim 151. A cover 16 is coupled and fixed to the upper rim 151. An inverter 17 is arranged in the cover 16. The inverter 17 supplies power to the electric motor in the motor housing 14.

Figure 2:
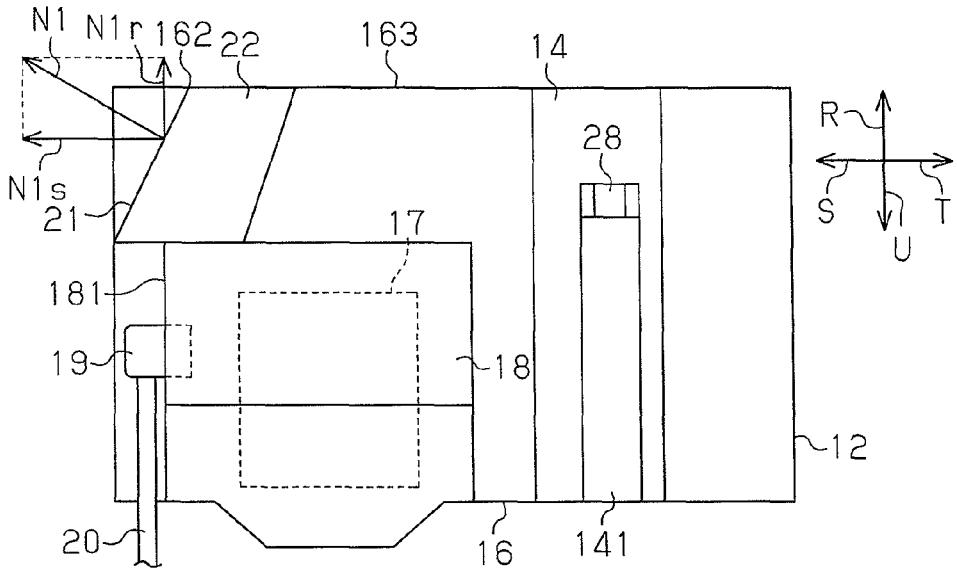
FIG. 2 is a plan view showing the electric compressor of FIG. 1A.
Figure 3:
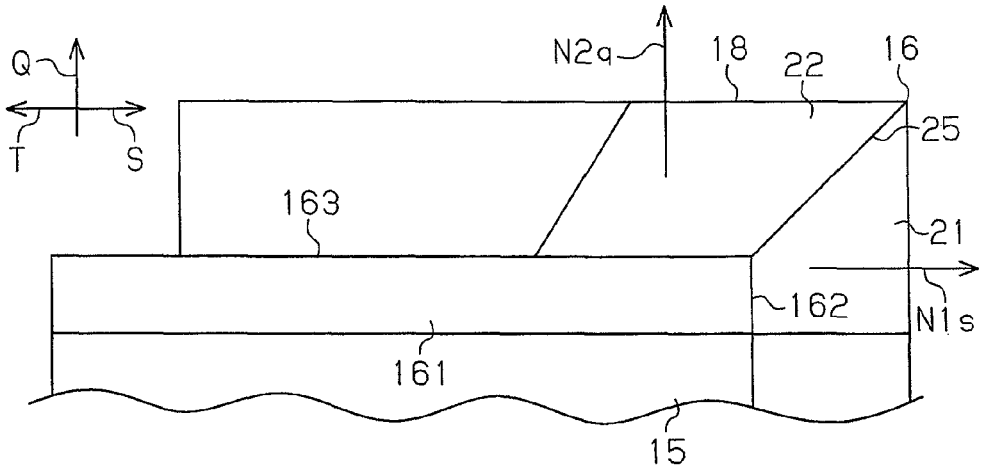
FIG. 3 is a partially enlarged front view of FIG. 1.

As shown in FIG. 2, the cover 16 is tetragonal when viewed from above. The cover 16 includes an upper surface on which an elevation 18 is formed. The elevation 18 is higher than other portions on the upper surface of the cover 16. The elevation 18 includes a side surface 181 that receives a plug 19. A conductive line 20 is connected to the plug 19. A vehicle high voltage supply source (not shown) is electrically connected to the conductive line 20. The inverter 17 is electrically connected to the vehicle high voltage supply source by the conductive line 20, which is coated by an insulator. The plug 19 and the conductive line 20 are conductive components arranged outside the cover 16 and electrically connected to the inverter 17.

In FIG. 2, the direction of arrow S indicates the leftward direction of the vehicle, and the direction of arrow T indicates the rightward direction of the vehicle. The cover 16 includes a front surface 161 with a left corner defining a first outer guide surface 21 and a second outer guide surface 22. The first outer guide surface 21 and the second outer guide surface 22 are planar and inclined relative to the forward direction R. The first outer guide surface 21 and the second outer guide surface 22 are arranged in front of the conductive components 19 and 20 in the forward direction R. That is, the first and second outer guide surfaces 21 and 22 are arranged at positions located closer to the outer side of the vehicle than the conductive components 19 and 20.

The front surface 161 of the cover 16 includes a side edge 162. The first outer guide surface 21 extends rearward (the direction indicated by arrow U in FIG. 2) and leftward (the direction indicated by arrow S) from the side edge 162.

Arrow N1 represents a normal N1 of the first outer guide surface 21. The normal N1 includes a sideward component N1*s* (first normal component), which is directed in the leftward direction S, and a forward component N1*r* (second normal component), which is directed in the forward direction R. The sideward component N1*s* (normal component extending in a direction perpendicular to the forward direction R) is larger than the forward component N1*r*.

As shown in FIG. 4, the front surface 161 of the cover 16 includes an upper edge 163. The second outer guide surface 22 extends rearward (the direction indicated by arrow U in FIG. 4) and upward (the direction indicated by arrow Q) from the upper edge 163. The first outer guide surface 21 and the second outer guide surface 22 are continuous and arranged side by side. A bounding edge 25 of the first outer guide surface 21 and second outer guide surface 22 extends leftward and upward from the front surface 161 to the rear.

Arrow N2 represents a normal N2 of the second outer guide surface 22. The normal N2 includes an upward component N2*q* (third normal component), which is directed in the upward direction Q, and a forward component N2*r* (fourth normal component), which is directed in the forward direction R. The upward component N2*q* (normal component extending in a direction perpendicular to the forward direction R) is larger than the forward component N2*r*.

As shown in FIG. 1A, two cooling fans 23 and 24 are arranged in front of the engine 11 to cool a radiator (not shown). The cooling fans 23 and 24 are respectively driven by electric motors 231 and 241. The cooling fan 23 is arranged in front of the electric compressor 12, and the electric motor 231 of the cooling fan 23 is arranged in front of the first outer guide surface 21 and second outer guide surface 22. The cooling fan 23 and the electric motor 231 are peripheral device located near the electric compressor 12.

In FIG. 1A, the direction of arrow Xo indicates the direction of an impact load produced when the vehicle encounters a head-on collision. The direction of arrow X1 indicates one example of the direction in which the electric motor 231 would be moved by the impact load. The electric motor 231, which is located in front of the first outer guide surface 21 and the second outer guide surface 22, is apt to moving toward and hitting the first outer guide surface 21 and second outer guide surface 22. Thus, when the vehicle encounters a head-on collision, the probability is high that the electric motor 231 will hit the first outer guide surface 21 or the second outer guide surface 22.

The electric motor 231 may hit the first outer guide surface 21, which is inclined to extend rearward and leftward from the front. In such a case, the first outer guide surface 21 deflects part of the impact in the left direction. This moderates the impact.

The electric motor 231 may hit the second outer guide surface 22, which is inclined to extend rearward and upward from the front. In such a case, the second outer guide surface 22 deflects part of the impact in the upward direction. This moderates the impact.

The first embodiment has the advantages described below.

(1) The first outer guide surface 21 deflects part of the impact, which is produced when hit by the electric motor 231, in the leftward direction and thus moderates the impact. The second outer guide surface 22 deflects part of the impact, which is produced when hit by the electric motor 231, in the upward direction and thus moderates the impact. Thus, there is a high probability that damage of the cover 16 and the inverter 17 will be avoided if the electric motor 231 hits the cover 16.

(2) The first outer guide surface 21 and the second outer guide surface 22 are located in front of the plug 19. Thus, the impact produced when the electric motor 231 hits the first outer guide surface 21 or the second outer guide surface 22 hardly affects the plug 19. As a result, the plug 19 is unlikely to be damaged when the vehicle encounters a head-on collision. This avoids damage of the plug 19 that results in electrical leakage.

(3) The first outer guide surface 21 and the second outer guide surface 22 are continuous, and inclined surfaces extending leftward or upward from the front are formed at a left corner of the cover 16. This ensures that impact is moderated when the electric motor 231 hits the left corner of the cover 16.

A second embodiment will now be described with reference to FIG. 5. To avoid redundancy, like or same reference numerals are given to those components that are the same as the corresponding components of the first embodiment. Such components will not be described in detail.

In the second embodiment, a second outer guide surface 22A is formed by an outwardly curved surface. The outwardly curved surface is shaped so that its cross-section is an outwardly curved line (e.g., arc) as viewed along a hypothetical plane parallel to the forward direction R and upward direction Q. Arrow N3 represents a normal N3 of the second outer guide surface 22A. The normal N3 includes an upward component N3*q*, which is directed in the upward direction Q, and a forward component N3*r*, which is directed in the forward direction R. The upward component N3*q* (normal component extending in a direction perpendicular to the forward direction R) is larger than the forward component N3*r*.

The second embodiment has the same advantages as the first embodiment.

A third embodiment will now be described with reference to FIG. 6. To avoid redundancy, like or same reference numerals are given to those components that are the same as the corresponding components of the first embodiment. Such components will not be described in detail.

In the third embodiment, a first outer guide surface 21A is formed by an outwardly curved surface. The outwardly curved surface is shaped so that its cross-section is an outwardly curved line (e.g., arc) as viewed along a hypothetical plane parallel to the forward direction R and leftward and rightward directions S and T. Arrow N4 represents a normal N4 of the first outer guide surface 21A. The normal N4 includes a sideward component N4*s*, which is directed in the leftward direction S, and a forward component N4*r*, which is directed in the forward direction R. The sideward component N4*s* (normal component extending in a direction perpendicular to the forward direction R) is larger than the forward component N4*r*.

The third embodiment has the same advantages as the first embodiment.

Figure 7:
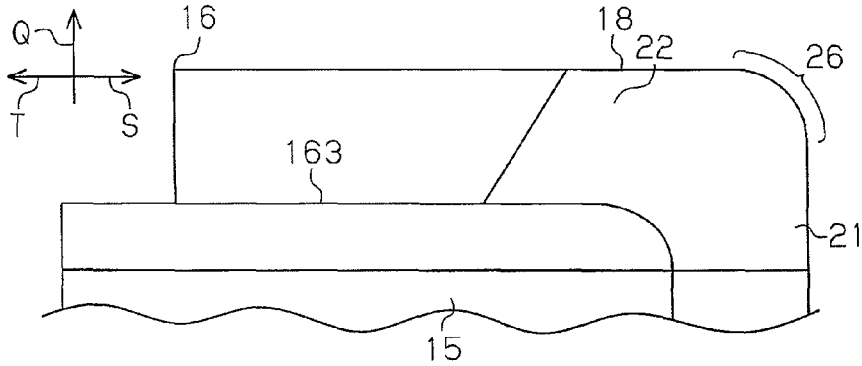
FIG. 7 is a partially enlarged front view showing an electric compressor according to a fourth embodiment of the present invention.

A fourth embodiment will now be described with reference to FIG. 7. To avoid redundancy, like or same reference numerals are given to those components that are the same as the corresponding components of the first embodiment. Such components will not be described in detail.

In the fourth embodiment, an outwardly curved surface 26 smoothly connects the first outer guide surface 21 and the second outer guide surface 22. The outwardly curved surface is shaped so that its cross-section is an outwardly curved line (e.g., arc) as viewed along a hypothetical plane parallel to leftward and rightward directions S and T and the upward direction Q.

The fourth embodiment has the same advantages as the first embodiment.

Figure 8:
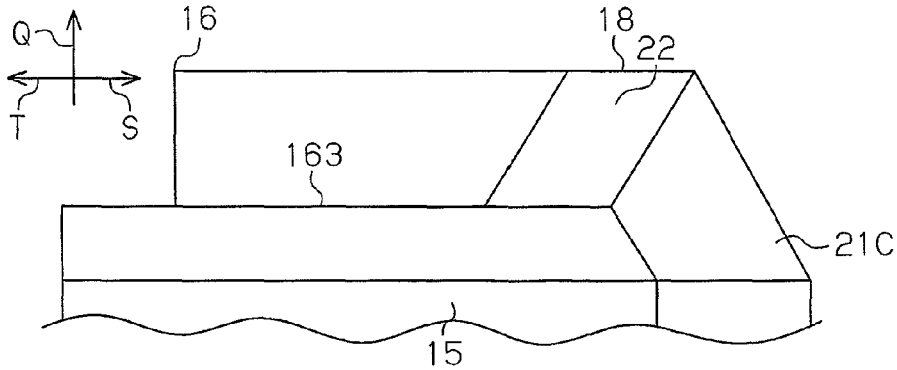
FIG. 8 is a partially enlarged front view showing an electric compressor according to a fifth embodiment of the present invention.

A fifth embodiment will now be described with reference to FIG. 8. To avoid redundancy, like or same reference numerals are given to those components that are the same as the corresponding components of the first embodiment. Such components will not be described in detail.

In the fifth embodiment, a first outer guide surface 21C is planar and inclined relative to the forward direction R and the upward direction Q. The fifth embodiment has the same advantages as the first embodiment.

A sixth embodiment will now be described with reference to FIG. 9. To avoid redundancy, like or same reference numerals are given to those components that are the same as the corresponding components of the first embodiment. Such components will not be described in detail.

In the sixth embodiment, a first outer guide surface 21B is formed by an inwardly curved surface. The inwardly curved surface is shaped so that its cross-section is an inwardly curved line (e.g., arc) as viewed along a hypothetical plane parallel to the forward direction R and leftward and rightward directions S and T. Arrow N5 represents a normal N5 of the first outer guide surface 21B. The normal N5 includes a sideward component N5*s*, which is directed in the leftward direction S, and a forward component N5*r*, which is directed in the forward direction R. The sideward component N5*s* (normal component extending in a direction perpendicular to the forward direction R) is larger than the forward component N5*r*.

The sixth embodiment has the same advantages as the first embodiment.

A seventh embodiment will now be described with reference to FIG. 10. To avoid redundancy, like or same reference numerals are given to those components that are the same as the corresponding components of the first embodiment. Such components will not be described in detail.

In the seventh embodiment, a second outer guide surface 22B is formed by an inwardly curved surface. The inwardly curved surface is shaped so that its cross-section is an inwardly curved line (e.g., arc) as viewed along a hypothetical plane parallel to the forward direction R and upward direction Q. Arrow N6 represents a normal N6 of the second outer guide surface 22B. The normal N6 includes an upward component N6*q*, which is directed in the upward direction Q, and a forward component N6*r*, which is directed in the forward direction R. The upward component N6*q* (normal component extending in a direction perpendicular to the forward direction R) is larger than the forward component N6*r*.

The seventh embodiment has the same advantages as the first embodiment.

An eighth embodiment will now be described with reference to FIGS. 11 and 12. To avoid redundancy, like or same reference numerals are given to those components that are the same as the corresponding components of the first embodiment. Such components will not be described in detail.

In the eighth embodiment, a filler 27 is arranged between the motor housing 14 and the bracket 13. The filler 27 is fixed to the motor housing 14 and formed from metal.

Figure 11:
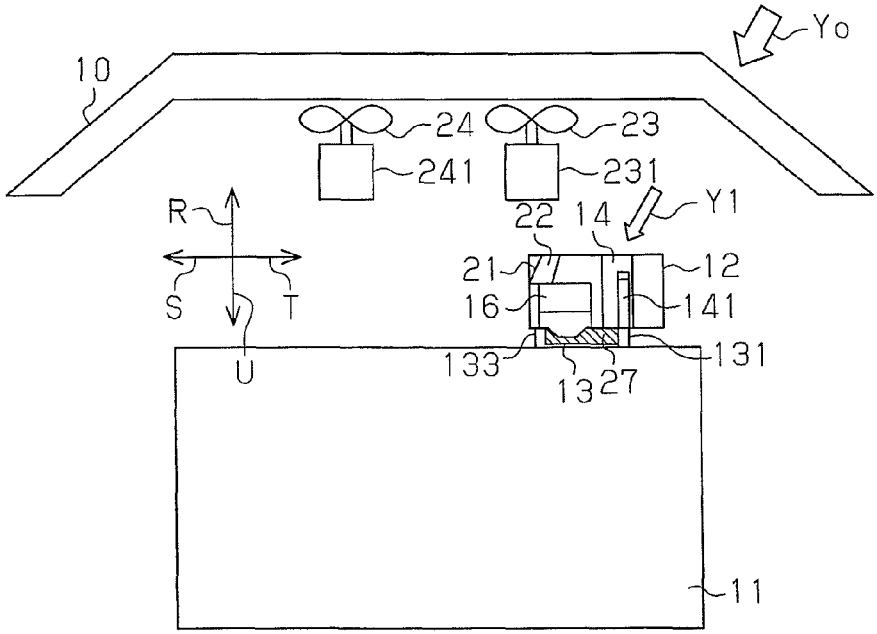
FIG. 11 is a plan view showing an electric compressor according to an eighth embodiment of the present invention.
Figure 12:
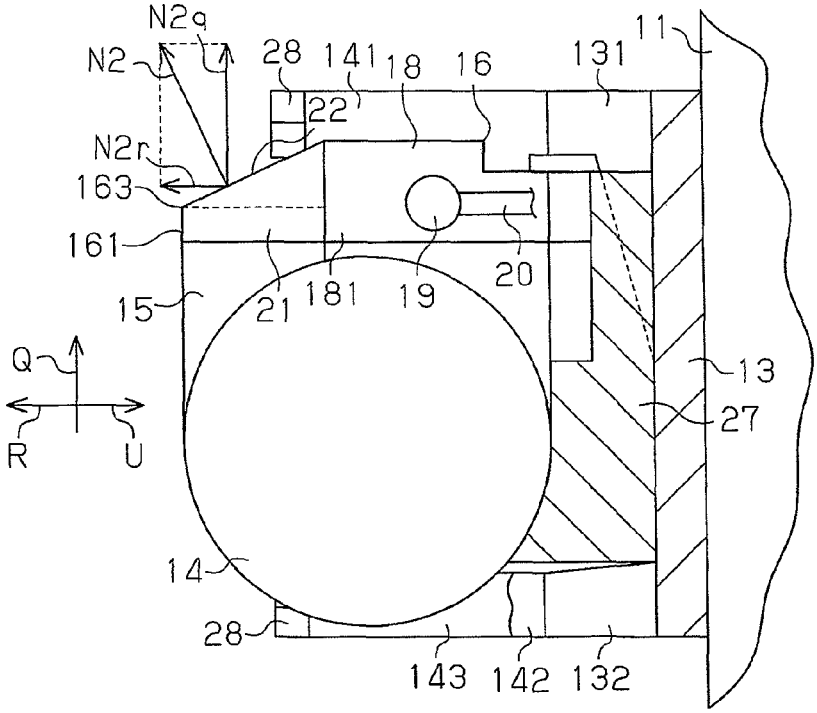
FIG. 12 is a side view showing the electric compressor of FIG. 11.

In FIG. 11, the direction of arrow Yo indicates the direction of an impact load produced when the vehicle encounters an offset collision, in which the vehicle is hit from a diagonally rightward direction. The direction of arrow Y1 indicates one example of the direction in which the electric compressor 12 would be moved by the impact load. When the electric compressor 12 is moved in the direction indicated by arrow Y1, the cover 16 may hit the bracket 13 and be damaged. However, the filler 27 prevents movement of the electric compressor 12 in such an offset collision. Thus, it would be unlikely for the cover 16 to hit the bracket 13, and damage of the cover 16 and inverter 17 will thereby be avoided.

Figure 13:
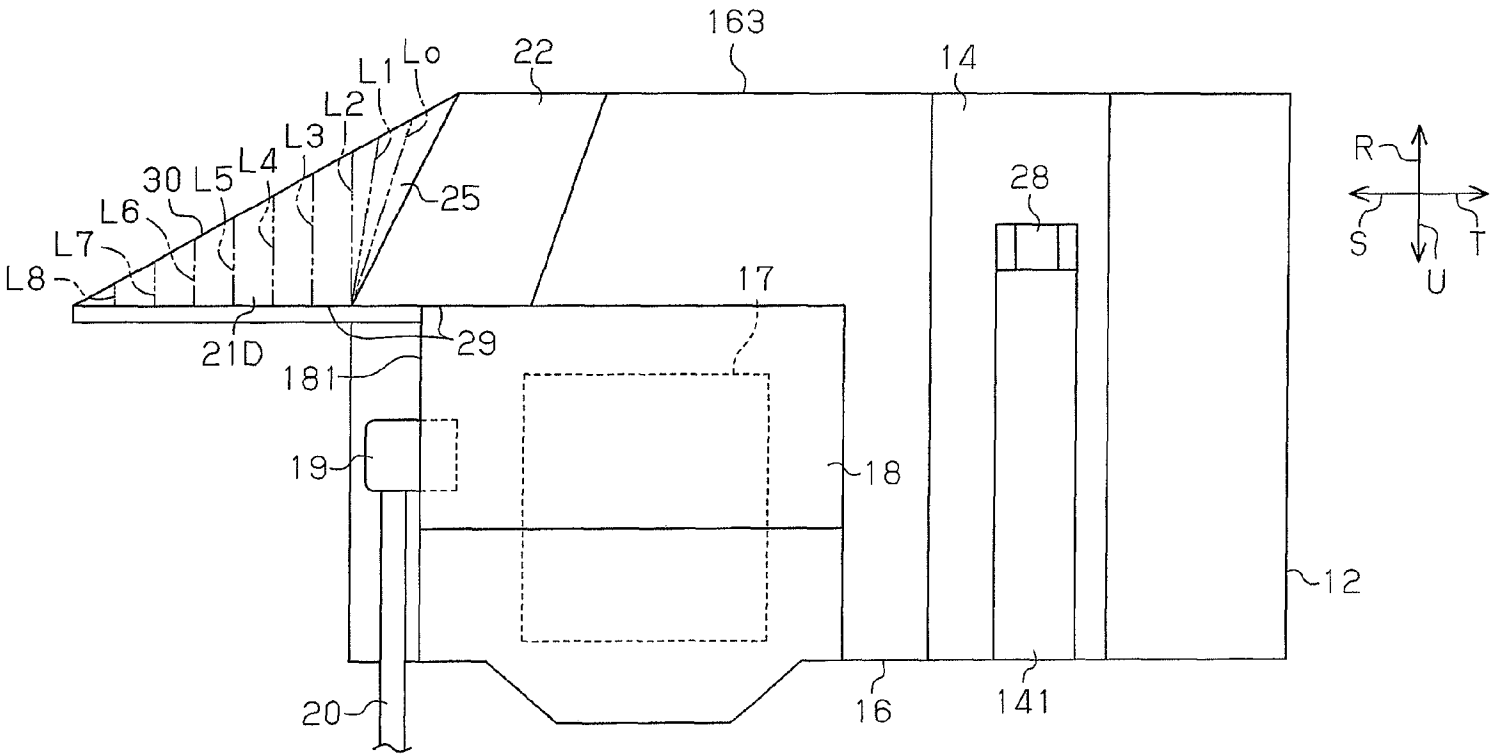
FIG. 13 is a partially enlarged front view showing an electric compressor according to a ninth embodiment of the present invention.
Figure 14:
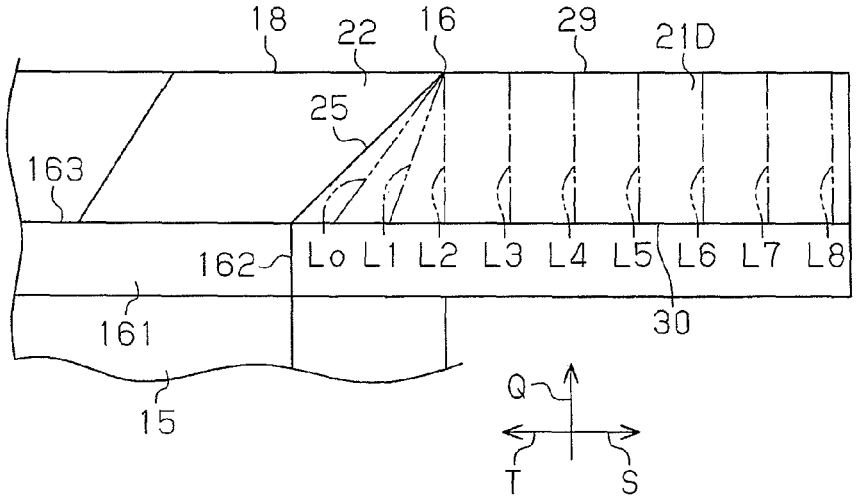
FIG. 14 is a partially enlarged front view showing the electric compressor of FIG. 13.
Figure 15:
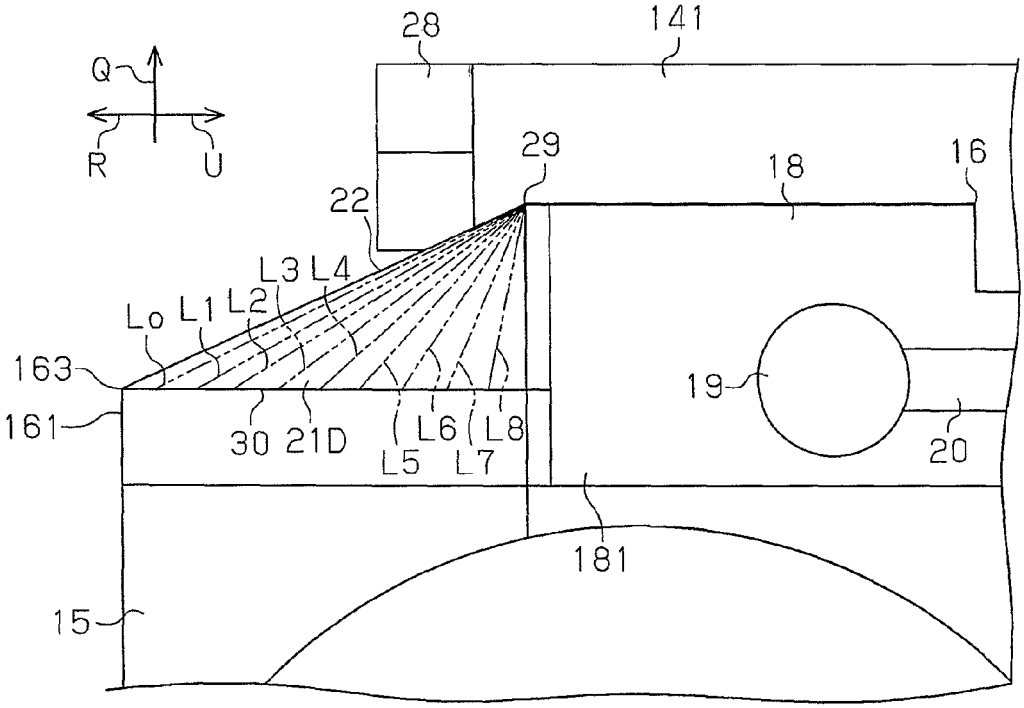
FIG. 15 is a partially enlarged side view showing the electric compressor of FIG. 13.

A ninth embodiment will now be described with reference to FIGS. 13 to 15. To avoid redundancy, like or same reference numerals are given to those components that are the same as the corresponding components of the first embodiment. Such components will not be described in detail.

In the ninth embodiment, a bounding edge 25 connects a first outer guide surface 21D and a second outer guide surface 22. The first outer guide surface 21D is generated by moving a generatrix (e.g., broken line Lo), which is a straight line, in the lateral direction while in contact with an upper edge 29, which extends in the leftward and rightward directions S and T, and a lower edge 30, which extends diagonally. Part of the broken line Lo and broken lines L1, L2, L3, L4, L5, L6, L7, and L8 are provisional straight lines added to the first outer guide surface 21D and shows examples of where the straight generatrix is located when moved in the leftward and rightward directions S and T.

When the vehicle encounters a collision and the electric motor 231 hits the first outer guide surface 21D, the first outer guide surface 21D deflects the electric motor 231 in the upward direction Q in addition to the leftward and rightward directions S and T. This moves the electric motor 231 away from the conductive components (i.e., the plug 19 and conductive line 20).

It should be apparent to those skilled in the art that the present invention may be embodied in many other specific forms without departing from the spirit or scope of the invention. Particularly, it should be understood that the present invention may be embodied in the following forms.

Figure 5:
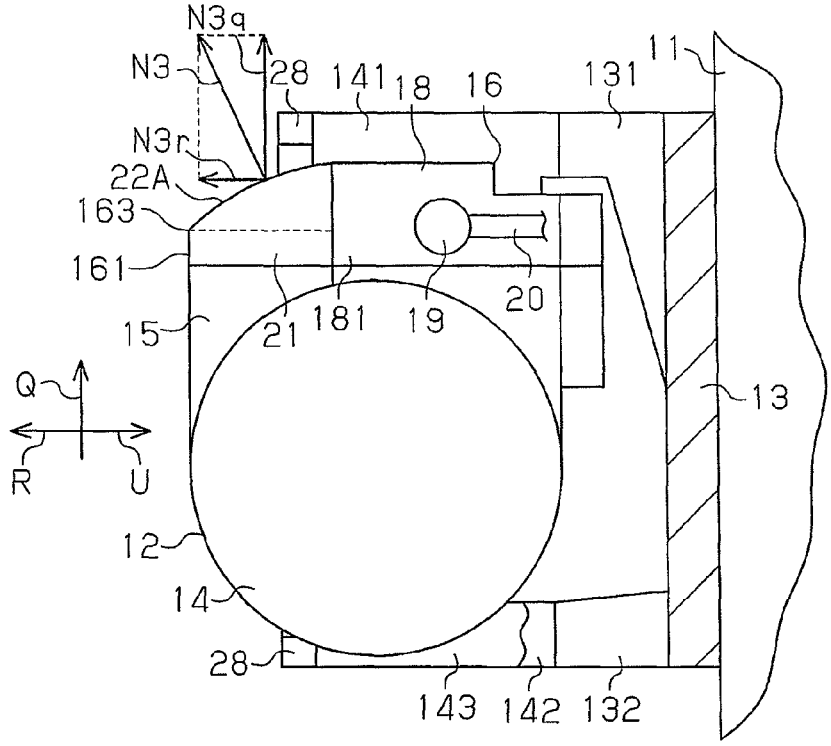
FIG. 5 is a side view showing an electric compressor according to a second embodiment of the present invention.
Figure 6:
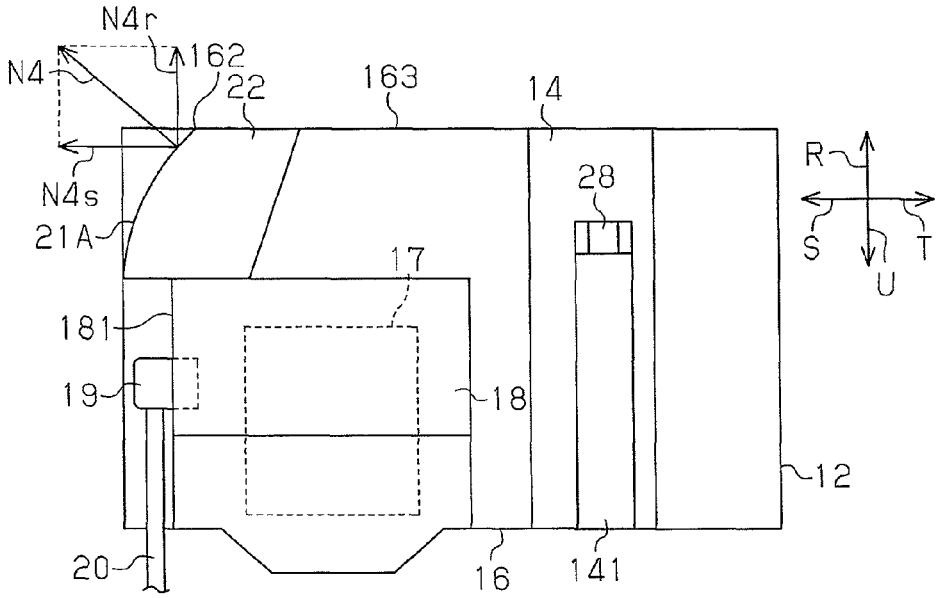
FIG. 6 is a plan view showing an electric compressor according to a third embodiment of the present invention.

The second embodiment of FIG. 5 and the third embodiment of FIG. 6 may be combined.

Figure 9:
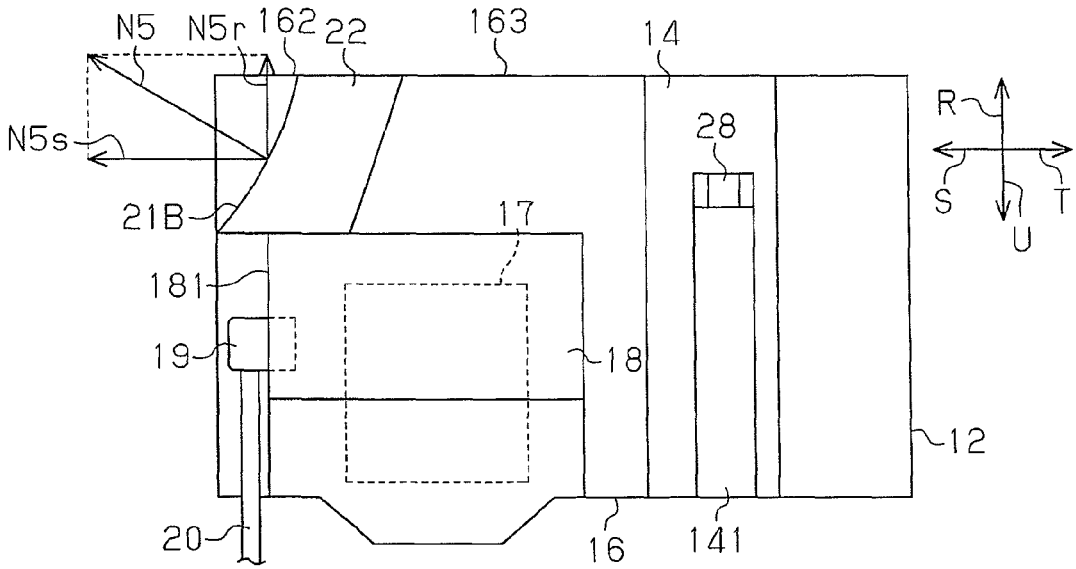
FIG. 9 is a plan view showing an electric compressor according to a sixth embodiment of the present invention.
Figure 10:
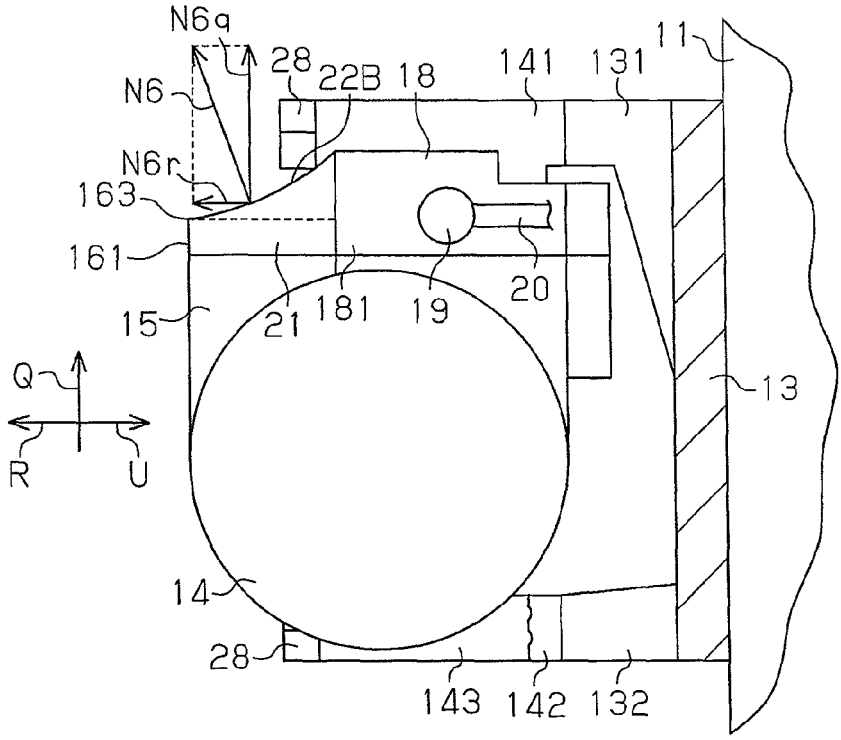
FIG. 10 is a side view showing an electric compressor according to a seventh embodiment of the present invention.

The sixth embodiment of FIG. 9 and the seventh embodiment of FIG. 10 may be combined.

The second outer guide surface may extend from a lower edge at the front surface 161 of the cover 16.

The cover 16 may include just a first outer guide surface.

The cover 16 may include just a second outer guide surface.

The filler 27 may be formed from a hard material other than metal.

The filler 27 may be formed integrally with the bracket 13.

The present invention may be applied to a structure in which the cover 16 is arranged on a side of the electric compressor 12.

The present examples and embodiments are to be considered as illustrative and not restrictive, and the invention is not to be limited to the details given herein, but may be modified within the scope and equivalence of the appended claims.

What is claimed is:

1. An electric compressor installed in a vehicle, the electric compressor comprising:

an inverter;

a cover covering the inverter; and a conductive component arranged outside the cover and electrically connected to the inverter;

wherein the cover includes an outer guide surface that is planar and is inclined relative to a forward direction of the vehicle;

the outer guide surface has a normal including a first normal component, which extends in a lateral direction of the vehicle, and a second normal component, which extends in the forward direction of the vehicle, wherein the first normal component is larger than the second normal component; and the outer guide surface is arranged closer to an outer side of the vehicle than the conductive component.

2. The electric compressor according to claim 1, wherein the outer guide surface is arranged in front of the conductive member in the forward direction.

3. The electric compressor according to claim 1, wherein:

the outer guide surface includes a first outer guide surface and a second outer guide surface;

wherein the first outer guide surface has the normal including the first normal component and the second normal component;

the second outer guide surface has a normal including third normal component, which extends in a vertical direction of the vehicle, and a fourth normal component, which extends in the forward direction of the vehicle;

and the third normal component is larger than the fourth normal component.

4. The electric compressor according to claim 3, wherein the first outer guide surface and the second outer guide surface are continuous.

5. The electric compressor according to claim 3, wherein the first outer guide surface is planar.

6. The electric compressor according to claim 3, wherein the second outer guide surface is planar.

7. The electric compressor according to claim 1, wherein:

the electric compressor is arranged in front of an engine of the vehicle; and a filler is arranged between a motor housing and the engine.

8. The electric compressor according to claim 1, wherein the normal is a component extending along a direction perpendicular to the forward direction and includes a component that is larger than the forward component.

9. The electric compressor according to claim 1, wherein the conductive component includes a front part located at a front side of the conductive component with the respect to the forward direction, and the cover is arranged to substantially cover the front part.

10. The electric compressor according to claim 1, wherein the conductive component includes a front part located at front side of the conductive component with respect to the forward direction, the cover is arranged to substantially cover the front part of the conductive component and is operative to substantially protect the front part of the conductive component.

* * * * *